United States Patent [19]

Leach

[11] 4,287,607

[45] Sep. 8, 1981

[54] BALLISTIC VESTS

[75] Inventor: Jack Leach, Greensboro, N.C.

[73] Assignee: Burlington Industries, Inc., Greensboro, N.C.

[21] Appl. No.: 39,780

[22] Filed: May 17, 1979

[51] Int. Cl.[3] ..... F41H 1/02

[52] U.S. Cl. ..... 2/2.5

[58] Field of Search ..... 2/2.5; 428/911, 101

[56] References Cited

U.S. PATENT DOCUMENTS

| | | | |
|---|---|---|---|
| 2,773,791 | 12/1956 | MacIver | 2/2.5 UX |
| 2,789,076 | 4/1957 | Frieder et al. | 428/911 |
| 2,808,588 | 10/1957 | Persico | 2/2.5 |
| 3,783,449 | 1/1974 | Davis | 2/2.5 |
| 3,821,071 | 6/1974 | Dietzel | 428/101 |
| 3,891,991 | 7/1975 | Leach | 2/2.5 |

*Primary Examiner*—Doris L. Troutman

*Attorney, Agent, or Firm*—Cushman, Darby & Cushman

[57] ABSTRACT

A bullet resistant vest is provided from a plurality of layers of double woven cloth of loosely-woven aramid fiber with nylon film or nylon fabric interposed between some of the layers of aramid fiber double woven cloth, bar tacking being provided for loosely maintaining the layers of double woven cloth and nylon film or fabric together so that shape and flexibility are maintained while not holding the aramid fiber too tightly. The cloth sheets in each layer of double woven cloth of aramid fiber are connected together at predetermined spaced intervals by selected yarns passing from one cloth sheet to the other. A plurality of densely woven material layers may be provided to maintain the vest configuration and prevent collapse over long periods of time, and the entire vest may be sealed in a water-tight envelope.

15 Claims, 3 Drawing Figures

Fig. 2
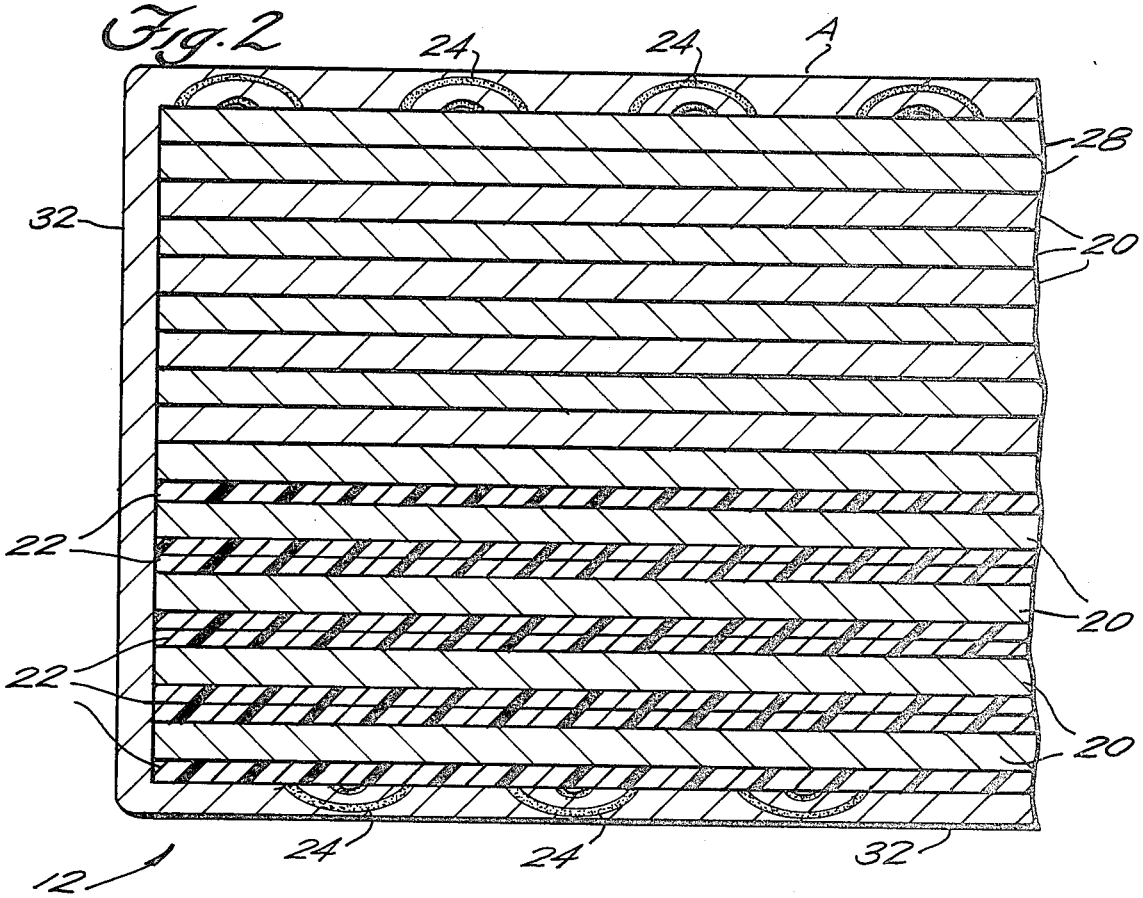
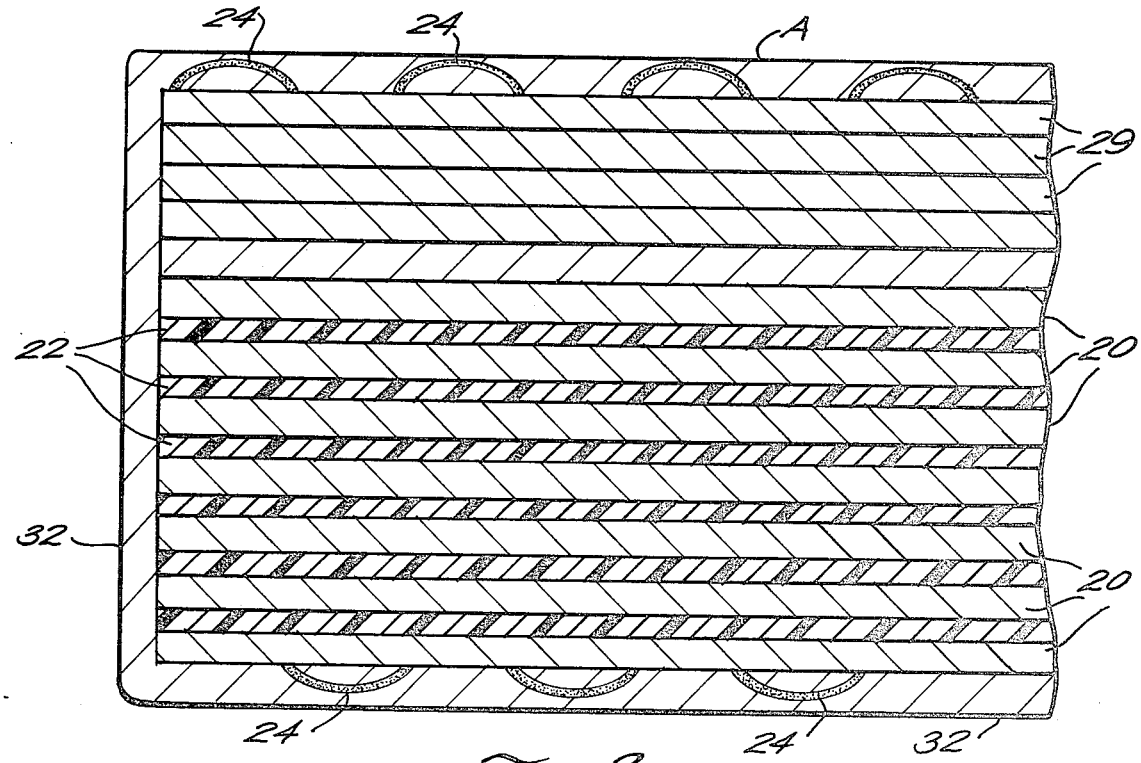
Fig. 3

BALLISTIC VESTS

BACKGROUND AND SUMMARY OF THE INVENTION

There have been numerous previous proposals for ballistic vests and other protective armour that can be constructed so as to stop projectiles from most guns without injuring the wearer yet providing a construction that is light enough so that it can be conveniently worn. While some of such prior art proposals, such as shown in U.S. Pat. No. 3,891,996, have been moderately successful in accomplishing such goals, there still is a need to provide a ballistic vest that will comply fully with all of the requirements considered desirable for widespread acceptance by policemen, civilian oriented protective agencies, and the like.

The vest as shown in U.S. Pat. No. 3,891,996 utilized sheets of aramid fiber for the basic construction of the vest, the aramid fiber providing exceptional strength per unit weight, and allowing a vest to be constructed that had excellent stopping power while still being light enough for normal use. In the practical application of such vests, the aramid fiber was densely woven and held rather tightly in place by tight stitching. It has been found, however, that when aramid fiber is maintained in a relatively unrestricted state the cutting resistance of the aramid fiber is greatly increased, and by using particular loosely woven aramid material arrangements the weight and thickness of the vest can be significantly reduced while still maintaining appropriate fiber density for ballistics protection.

According to the present invention, a vest is provided that utilizes as the basic components thereof a plurality of layers of double woven cloth of loosely woven aramid fiber. The layers of double woven cloth are stitched together at predetermined spaced intervals by selected yarns passing from one cloth sheet to the other, such as shown in U.S. Pat. No. 2,816,578 (the disclosure of which is hereby incorporated by reference herein). Each layer of double woven cloth so constructed will preferably have a 34 by 34 construction, although other constructions that provide for low weight and thickness while still maintaining sufficient fiber density for ballistics protection may be utilized. Means are also provided in the vest according to the invention to provide a degree of elongation to the total vest configuration, providing surfaces on which the layers of double woven cloth of loosely woven aramid fiber can slide in response to projectile impact. Such elongation providing means having synergistic effect on the total composition, giving a somewhat elastic property to the vest allowing it to give with the bullet during the absorption of the kinetic energy thereof, and then recover with a fair degree of rapidity to approximately its original configuration. Layers of nylon film or fabric interspersed with the layers of double woven cloth of aramid fiber provide the necessary elongation characteristics.

The layers of double woven cloth of aramid fiber and the interspersed layers of nylon film or fabric are bar tacked together by short lines of stitches, such bar tacking providing means for loosely maintaining the layers of double woven cloth and nylon film or fabric together so that shape and flexibility are maintained. Such bar tacking gives the vest the minimum rigidity to hold the layers in place and prevent any substantial lateral movement while still allowing sufficient movement of the aramid fiber so that it will not easily shear. While the bar tacking does provide minimum rigidity, in order to maintain vest configuration and prevent collapse of the vest over long periods of time it is preferable to provide a plurality of material layers which help maintain the configuration and prevent collapse. Such layers may comprise sheets of ballistic nylon cloth or tightly woven aramid fiber, both of which are shown in U.S. Pat. No. 3,891,996. The entire vest is disposed in a water-tight envelope, such as a heat sealable polyurethane coated nylon substrate material. While water-tightness is desirable, there is no need for the envelope to be airtight and in order to minimize costs the envelope preferably is airpermeable.

Vests constructed according to the present invention are lightweight, relatively thin, will maintain their integrity over long periods of time, and are capable of fully complying with standard protection criteria for 0.22 calibre, 0.38 calibre, 9 millimeter, and 0.357 magnum (both high and low velocity) projectiles.

It is the primary object of the present invention to provide improve lightweight ballistic vests, and like protective armour. This and other objects of the invention will become clear from an inspection of the detailed description of the invention and from the appended claims.

BRIEF DESCRIPTION OF THE DRAWINGS

FIG. 2 is a partial cross-sectional view 5 one embodiment of an exemplary vest body portion according to the invention; and FIG. 3 is a cross-sectional view like that of FIG. 2 for another vest embodiment according to the invention.

DETAILED DESCRIPTION OF THE DRAWINGS

Figure 1:
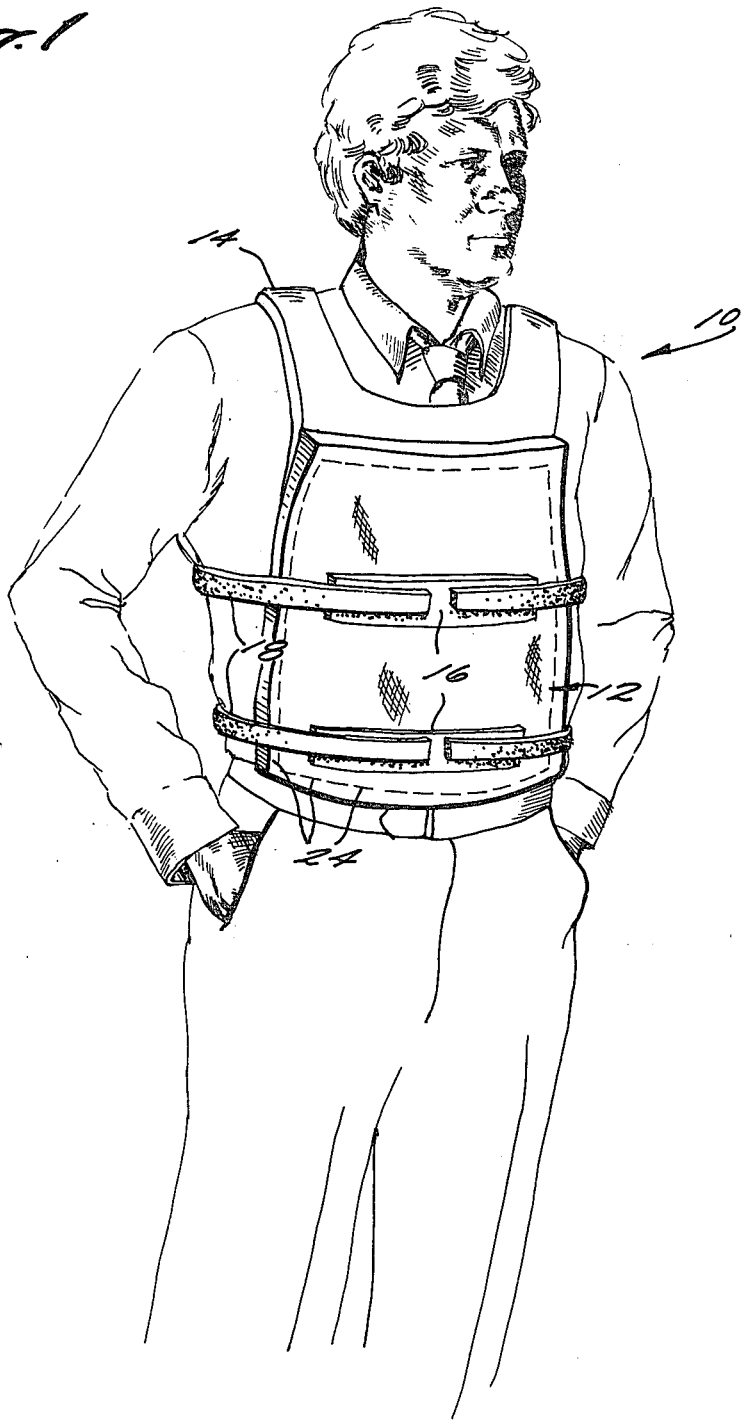
FIG. 1 is a perspective view of an exemplary completed ballistic vest according to the invention as it might be worn by a user.

An exemplary ballistic vest according to the present invention is shown generally at 10 in FIG. 1. While the invention description is particularly directed to ballistic vests, it is apparent that other protective armour can also be constructed utilizing the teachings of the invention.

The vest 10 includes a body portion 12, shoulder straps 14 or the like, and suitable components for maintaining the vest in place on the wearer, such as loop-pile fasteners straps 16 disposed on the outer surface of the body 12 and cooperating with loop-pile fasteners straps 18. A back portion comparable to body portion 12 also is preferably provided. Of course a wide variety of fastening arrangements may be employed, such as shown and described in U.S. Pat. No. 3,891,996.

The basic ballistic components of the body 12 of the vest according to the invention are a plurality of layers of double woven cloth of loosely woven aramid fiber 20 (see FIGS. 2 and 3). Each layer forming a structure 20 may, for example, have a plain weave and be about 13 mils thick, using 1400 denier yarn, in a 17×17 construction. Each layer of double woven cloth 20 is laminated together at predetermined spaced intervals by selected yarns passing from one sheet to the other, such as shown in U.S. Pat. No. 2,816,578 (the disclosure of which is hereby incorporated by references herein). The layer of double woven cloth 20 thus formed has a 34×34 construction. Such an arrangement has reduced weight and thickness compared to densely woven aramid fiber material, while sufficient fiber density is maintained for good ballistics use. Also, the aramid fibers are minimally restricted so that they are more resistant to shearing forces than tightly held aramid fibers. Commercially available Kevlar is eminently suited for forming the double woven cloth of the invention. While other high tensile strength synthetic organic plastic fiber materials such as polycarbonates, polyesters, and acetal resins may be utilized in some circumstances instead of aramid fiber yarns, aramid fibers are presently believed to provide the least weight for a given strength and thus are eminently suited for use in the protective armour according to this invention.

The body portion 12 also includes means for providing elongation to the vest and providing surfaces on which the double sheets 20 can slide in response to projectile impact. Such means preferably include a plurality of layers 22 of elongatable material interspersed between the sheets 20, such as layers of nylon film or nylon fabric (ballistic nylon fabric is not required). Uncoated nylon film about 3 mils thick, in either single or double layers, is especially suitable as the elongation providing means. Other plastic film materials besides nylon, such as polyethylene, polycarbonate, or polyurethane may be suitable under some circumstances, and other thin woven cloth materials, including those formed from Dacron (polyester) may also be utilized.

The vest body 12 further includes means for loosely maintaining the layers 20 and the layers 22 together so that shape and flexibility of the vest are maintained. It is important that minimum rigidity be provided to hold the layers in place and prevent substantial lateral movement, however it is also important to retain some looseness of the aramid fiber in order to maximize the shear resistance thereof responsive to projectile impact. Such maintaining means are preferably provided by utilizing bar tacking 24 (short lines of stitches). For clarity, the bar tacking is also illustrated in FIG. 1 although normally it will not be seen on the exterior of the body portion 12.

While bar tacking 24 provides minimum rigidity of the vest, extended use over long periods of time (e.g. one year) might cause the vest to collapse. In order, to avoid this, preferably means are provided for maintaining the vest configuration and preventing collapse of the vest over long periods of time. Such means may take the form of a plurality of material layers, such as a plurality of layers of ballistic nylon cloth 28 (FIG. 2), or a plurality of layers of tightly woven aramid fiber sheets 29 (FIG. 3). Exemplary ballistic nylon cloth and tightly woven aramid fiber sheets are disclosed in U.S. Pat. No. 3,891,996.

The entire sandwich formed by the layers 20, 22, and 28 or 29 preferably is enclosed in a water-tight envelope 32. The material forming the envelope may comprise a polyurethane coated nylon fabric which is heat sealed to securely maintain the sandwich so that it is water-tight. It is not essential for proper operation of the invention that the envelope material be airtight. In order to minimize costs it is preferable that the material forming the envelope be only air-permeable. Thus many commercial water repellant treated fabrics are suitable for forming the envelope 32.

Two examples of suitable constructions for ballistic vests according to the invention are illustrated in FIGS. 2 and 3. In the vest of FIG. 2, the body portion 12 includes—looking from the surface A which is adapted to be disposed adjacent the body of the user—two layers 28 of ballistic cloth nylon, double woven cloth 20 of loosely woven aramid fiber, a layer 22 of uncoated nylon film, a layer of double woven cloth 20, two layers 22, a layer 20, two layers 22, a layer 20, two layers 22, a layer 20, and a layer 22. The entire sandwich is held together by bar tacking 24 and placed in an envelope 32 of polyurethane coated nylon fabric. In actual tests of the vest of FIG. 2 by the Equipment Technology Center of the International Association of Chiefs of Police, the vests were found in full compliance with the established criteria for stopping 0.22 calibre and 0.38 calibre bullets, low velocity 9 millimeter and 0.357 magnum bullets, and high velocity 9 millimeter and 0.357 magnum bullets.

In the embodiment of FIG. 3, looking from the surface A closest to the body, there are four layers of tightly woven aramid fiber 29 two layers 20, a layer 22, and six alternating layers 20 and layers 22. The number of layers 20 provided, and their exact sequence of interspersing with layers 22, will be dictated by the types of projectiles the vest is designed to stop, as well as by cost and weight criteria.

It will thus be seen that according to the present invention a ballistic vest or like protective armour has been provided which has excellent stopping power while being light in weight and readily utilizable. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to cover all equivalent structures and devices.

What is claimed is:

1. A ballistic vest comprising a plurality of double cloth layers of loosely woven aramid fiber, the layers of double woven cloth being stitched together at predetermined spaced intervals by selected yarns passing from one cloth sheet to the other;

means for providing elongation to the vest and providing surfaces on which said layers of double woven cloth can slide in response to projectile impact; and means for loosely maintaining said layers of double woven cloth and elongation providing means together so that shape and flexibility are maintained.

2. A vest as recited in claim 1 comprising means for maintaining vest configuration and preventing collapse of the vest over long periods of time.

3. A vest as recited in claim 2 wherein said configuration maintaining and collapse preventing means comprise a plurality of material layers selected from the group consisting of ballistic nylon cloth and cloth of tightly woven aramid fiber.

4. A vest as recited in claim 1 further comprising a water-tight envelope enclosing the vest.

5. A vest as recited in claim 4 wherein said water-tight envelope is constructed of a heat sealable polyurethane coated nylon substrate material.

6. A vest as recited in claim 1 wherein said means for loosely maintaining together said layers of double woven cloth and said elongation providing means, comprise bar tacking.

7. A vest as recited in claim 1 wherein said elongation providing means comprises a plurality of layers of elongatable material interspersed between layers of double woven cloth of aramid fiber.

8. A vest as recited in claim 7 wherein said elongatable material is selected from the group consisting essentially of nylon film and nylon fabric.

9. A vest as recited in claim 8 wherein said vest comprises a sandwich of 8 layers of double woven cloth of aramid fiber, a layer of nylon film, a layer of double woven cloth of aramid fiber, a layer of nylon film, a layer of double woven cloth of aramid fiber, a layer of nylon film, a layer of double woven cloth of aramid fiber, a layer of nylon film, a layer of double woven cloth of aramid fiber, and a layer of nylon film.

10. A vest as recited in claim 9 further comprising a plurality of layers selected from the group consisting essentially of nylon cloth and tightly woven aramid fiber layers.

11. A vest as recited in claim 10 further comprising a water-tight envelope enclosing said vest sandwich.

12. A vest as recited in claim 4 or claim 11 wherein said water-tight envelope is air permeable.

13. A vest as recited in claim 1 or claim 10 wherein each layer of double woven cloth of aramid fiber has a 34×34 construction.

14. A vest as recited in claim 9 wherein some of said layers of nylon film are double layers of nylon film.

15. A vest as recited in claim 8 or claim 9 or claim 14 wherein said nylon film is uncoated.

* * * * *